US005433185A

United States Patent [19]

Toyoda

[11] Patent Number: 5,433,185

[45] Date of Patent: Jul. 18, 1995

[54] AIR-FUEL RATIO CONTROL SYSTEM FOR USE IN AN INTERNAL COMBUSTION ENGINE

[75] Inventor: Katsuhiko Toyoda, Shizuoka, Japan

[73] Assignee: Suzuki Motor Corporation, Shizuoka, Japan

[21] Appl. No.: 124,339

[22] Filed: Sep. 20, 1993

[30] Foreign Application Priority Data

Dec. 28, 1992 [JP] Japan ..... 4-361519

[51] Int. Cl.[6] ..... F02D 41/14

[52] U.S. Cl. ..... 123/682; 123/688; 123/696

[58] Field of Search ..... 123/682, 688, 694, 695, 123/696, 690

[56] References Cited

U.S. PATENT DOCUMENTS

| | | | |
|---|---|---|---|
| 4,638,658 | 1/1987 | Otobe | 123/690 |
| 4,693,076 | 9/1987 | Chujo et al. | 60/274 |
| 4,707,984 | 11/1987 | Katsuno et al. | 60/274 |
| 4,720,973 | 1/1988 | Katsuno | 60/274 |
| 4,744,344 | 5/1988 | Morozumi | 123/695 |
| 4,831,838 | 5/1989 | Nagai | 60/274 |
| 4,854,124 | 8/1989 | Tamura | 60/274 |
| 4,977,881 | 12/1990 | Abe et al. | 123/674 |
| 4,981,122 | 1/1991 | Osawa et al. | 123/682 |
| 5,154,054 | 10/1992 | Nakane et al. | 60/276 |
| 5,154,055 | 10/1992 | Nakane et al. | 60/276 |
| 5,157,921 | 10/1992 | Ito et al. | 60/274 |
| 5,168,700 | 12/1992 | Furuya | 60/274 |
| 5,168,701 | 12/1992 | Yamamoto | 60/274 |
| 5,179,924 | 1/1993 | Manaka | 123/682 |
| 5,193,339 | 3/1993 | Furuya | 60/274 |
| 5,220,788 | 6/1993 | Kurita | 60/274 |
| 5,280,707 | 1/1994 | Nakashima et al. | 60/276 |

FOREIGN PATENT DOCUMENTS

| | | |
|---|---|---|
| 61-192825 | 8/1986 | Japan . |
| 61-250355 | 11/1986 | Japan . |
| 3-253714 | 11/1991 | Japan . |
| 4-008854 | 1/1992 | Japan . |

*Primary Examiner*—Andrew M. Dolinar
*Attorney, Agent, or Firm*—Flynn, Thiel, Boutell & Tanis

[57] ABSTRACT

An air-fuel ratio control system for an internal combustion engine in which an exhaust sensor is located in an exhaust path of the internal combustion engine. A control means provides feedback control to match an air-fuel ratio with a target value in accordance with a detection signal from the exhaust sensor. The control means is provided with a correction section which, upon fulfillment of predetermined implementation conditions of correction determination, detects a response time that elapses from the occurrence of a change in an operating state of the internal combustion engine until the detection signal from the exhaust sensor issues a determination signal value. The correction section governing the feedback control of the air-fuel ratio corrects the feedback control in accordance with the detected response time.

2 Claims, 9 Drawing Sheets

$$FRATAV = \sum_{n=1}^{14} FRAT/14$$

FRATAVnew

KFRAT= (FRATAVold+FRATAVnew) ÷2

LIML≤KFRAT≤LIMH or IRL=IRLold+KIRL
ILR=ILRold+KILR or SRL=SRLold+KSRL
SLR=SLRold+KSLR or DRL=DRLold+KDRL
DLR=DLRold+KDLR

AIR-FUEL RATIO CONTROL SYSTEM FOR USE IN AN INTERNAL COMBUSTION ENGINE

FIELD OF THE INVENTION

The present invention relates to an air-fuel ratio control system for use in an internal combustion engine. More particularly, it relates to air-fuel ratio control system which is capable of correcting variations in a detection signal from an exhaust sensor due to manufacturing non-uniformities, deterioration during use, and the like, of the exhaust sensor which is positioned in an exhaust path of the internal combustion engine, thereby enabling high-precision feedback control such that an air-fuel ratio achieves its target value.

BACKGROUND OF THE INVENTION

Some internal combustion engines disposed in vehicles are provided with an air-fuel ratio control system that includes an $O_2$ sensor and a control means. The $O_2$ sensor, which serves as an exhaust sensor, is located in an exhaust path of the internal combustion engine. The control means provides feedback control such that an air-fuel ratio achieves its target value in accordance with a detection signal which is sent out from the $O_2$ sensor.

Japanese Laid-Open Patent No. 61-250355 discloses this type of air-fuel ratio control system for an internal combustion engine. The air-fuel ratio control system disclosed therein is provided with a correcting means which calculates a difference between a first sample time and a second sample time, and corrects the air-fuel ratio in accordance with the difference. The first sample time corresponds to a period of time that elapses between the moment an inversion from a rich air-fuel ratio to a lean air-fuel ratio in an air/fuel mixture occurs, and the moment the inversion is detected by the exhaust sensor. The second sample time indicates a period of time after an inversion from a rich air-fuel ratio to a lean air-fuel ratio in the air/fuel mixture occurs until the inversion is detected by the exhaust sensor.

Other internal combustion engines disposed in vehicles provide air-fuel ratio control systems that include a first $O_2$ sensor, a second $O_2$ sensor, and a control means. Serving as exhaust sensors, the first $O_2$ sensor and the second $O_2$ sensor are located respectively on an upstream side and a downstream side of a catalyzer which is positioned in an exhaust path of the internal combustion engine. The control means effects feedback control such that an air-fuel ratio achieves its target value in accordance with first and second detection signals which are sent out respectively from the first and second $O_2$ sensors.

Japanese Laid-Open Patent No. 61-192825 discloses this latter type of air-fuel ratio control system for an internal combustion engine. This air-fuel ratio control system has first and second $O_2$ sensors positioned respectively upstream and downstream from a catalyzer in an exhaust path of the internal combustion engine in order to effect air-fuel ratio feedback control. The first exhaust sensor, which is positioned upstream from the catalyzer in the exhaust path, is located in a cylinder head of the internal combustion engine.

A problem with exhaust sensors is that variations in a detection signal from an exhaust sensor make it difficult to provide high-precision feedback control such as to match an air-fuel ratio with its target value. Such variations result from manufacturing non-uniformities, deterioration during use, and the like.

In order to overcome the above problem, an air-fuel ratio control system having two sensors and a control means has been proposed, as disclosed in aforesaid Japanese Patent No. 61-192825. More specifically, a first $O_2$ sensor and a second $O_2$ sensor are located respectively at an upstream portion and a downstream portion of-an exhaust path of the internal combustion engine with respect to a catalyzer which is positioned in the exhaust path. The control means effects feedback control such as to match an air-fuel ratio with its target value in accordance with a first detection signal and a second detection signal which are sent out respectively from the first $O_2$ sensor and the second $O_2$ sensor.

The air-fuel ratio control system disclosed in aforesaid Japanese Patent No. 61-192825 provides a first feedback control in response to the first detection signal from the first $O_2$ sensor, in order to match an air-fuel ratio with its target value. Further, the first feedback control is controlled so as to be corrected in accordance with the second detection signal from the second $O_2$ sensor. However, the $O_2$ sensors are subject to manufacturing non-uniformities and deterioration as previously mentioned. As shown in FIG. 15, a further problem resulting from the above is that variations occur in the reaction time and voltage of a detection signal which an $O_2$ sensor sends out in accordance with an air-fuel ratio in an air/fuel mixture. Foe example, a curve "a" represents $O_2$ sensor variations for a product having an upper reaction limit, curve "b" represents $O_2$ sensor variations for a normal product having a central value and curve "c" represents $O_2$ sensor variants for a deterioration-resistant product having a lower reaction limit. The variation in the detection signal from the $O_2$ sensor introduces a change in a reaction cycle, as shown in FIG. 16, which results in changes in the corrected quantity FAF and time of feedback control. A problem arising therefrom is that an actual air-fuel ratio considerably swings with reference to $\lambda=1$. For this reason, high-precision feedback control cannot be provided to match an air-fuel ratio with a target value which is required for the catalyzer to improve its clean-up efficiency. As a result, the air-fuel ratio falls out of the target value. This disadvantageously reduces the clean-up efficiency of the catalyzer, while increasing the amount of noxious components in the exhaust emissions.

To obviate the above-described drawbacks, the present invention provides an air-fuel ratio control system for use in an internal combustion engine, in which an exhaust sensor is located in an exhaust path of the internal combustion engine and a control means is provided for effecting feedback control to match an air-fuel ratio with its target value in accordance with a detection signal sent out from the exhaust sensor. The control means is provided with a correction section which, upon fulfillment of predetermined implementation conditions of correction determination, detects a response time that elapses from the moment a change in an operating state of the internal combustion engine occurs, to the moment the detection signal from the exhaust sensor achieves a determination signal value. The correction section governs the feedback control of the air-fuel ratio, which has been effected by means of the exhaust sensor, in accordance with the detected response time so as to correct the feedback control.

Pursuant to the system of the present invention, when predetermined implementation conditions of correction determination are fulfilled, the correction section, which is provided in the control means, detects the response time which elapses after the occurrence of a change in an operating state of the internal combustion engine until the detection signal sent out from the exhaust sensor achieves a determination signal value. In accordance with the detected response time, the correction section governs air-fuel ratio feedback control, which has been effected by means of the exhaust sensor, so as to correct the air-fuel feedback control. In this way, the use of the single exhaust sensor can correct variations in the detection signal from the exhaust sensor, which variations result from manufacturing non-uniformities, deterioration during use, or the like, of the exhaust sensor. As a result, high-precision air-fuel ratio feedback control is achievable.

BRIEF DESCRIPTION OF THE DRAWINGS

An embodiment of the present invention will be described in detail with reference to the drawings.

DETAILED DESCRIPTION OF THE INVENTION

Figure 1:
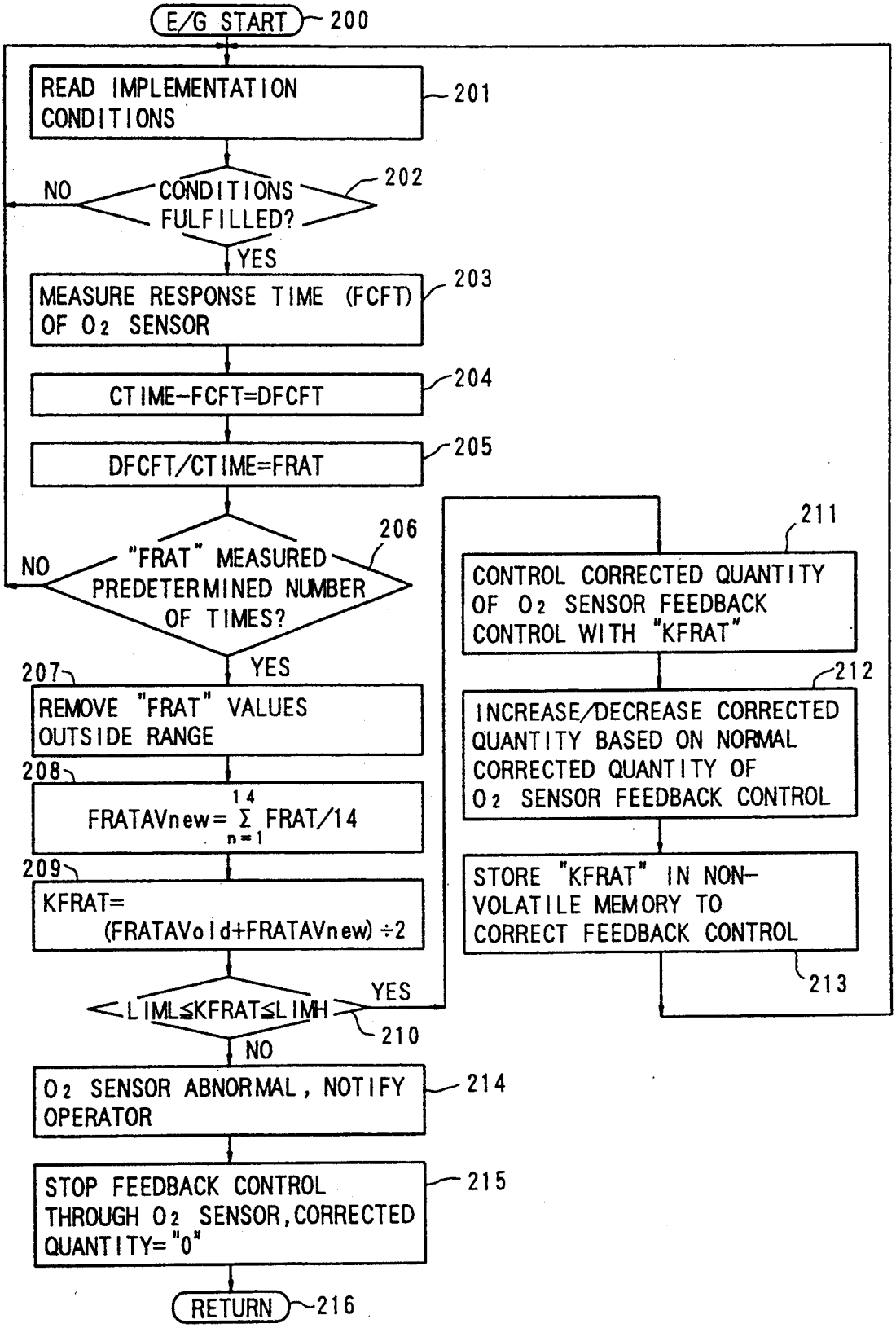
FIG. 1 is a flow chart which illustrates how control is effected by an air-fuel ratio control system for use in an internal combustion engine according to an embodiment of the present invention.

FIGS. 1 through 14 show an embodiment of an air-fuel ratio control system according to the present invention. In FIG. 14, there is shown an internal combustion engine 2, an intake path 4, and an exhaust path 6. The intake path 4, which leads to the internal combustion engine 2, includes an air cleaner 8, an airflow meter 10, a throttle body 12, and an intake manifold 14, all of which are connected in series in the flow direction of the intake path 4. The intake path 4 within the throttle body 12 is provided with an intake throttle valve 16. The intake path 4 communicates with a combustion chamber 18 of the internal combustion engine 2.

The exhaust path 6, which communicates with the combustion chamber 18, is defined by an exhaust manifold 20, an upstream exhaust pipe 22, a catalytic converter 24, and a downstream exhaust pipe 26, all of which are connected in series in the downstream direction. The catalytic converter 24 is provided with a catalyzer 28.

The internal combustion engine 2 has a fuel injection valve 30 positioned adjacent and directed toward the combustion chamber 18. A fuel supply path 34 permits the fuel injection valve 30 to communicate with a fuel tank 36 via a fuel distribution path 32. Fuel within the fuel tank 36 is compressed and drawn away therefrom by a fuel pump 38, and is filtered by a fuel filter 40 so as to remove dust and dirt therefrom. The filtered fuel is fed into the fuel distribution path 32 through the fuel supply path 34, and is then dispensed to the fuel injection valve 30. The fuel distribution path 32 has a fuel pressure-regulating section 42 disposed therein in order to regulate fuel pressure. The fuel pressure-regulating section 42 regulates fuel pressure to a given value through the aid of intake pressure which is introduced therein from a lead path 44 that communicates with the intake path 4. Excess fuel is returned to the fuel tank 36 through a fuel return path 46.

The fuel tank 36 communicates with the intake path 4 within the throttle body 12 through a vapor fuel path 48. A two-way valve 50 and a canister 52 are interposed midway along the vapor fuel path 48. In addition, the throttle body 12 is defined with a by-pass pathway 54 which bypasses the intake throttle valve 16. An idle air quantity control valve 56 is interposed midway along the by-pass pathway 54. Reference numerals 58, 60, 62, 64, and 66 respectively represent an air regulator, a power steering switch, a power steering air quantity control valve, a blow-by gas path, and a PCV valve.

The airflow meter 10, the fuel injection valve 30, the idle air quantity control valve 56, and the power steering air quantity control valve 62 are linked to a control station 68 which serves as a control means. Further, the control station 68 is coupled separately to: a crank angle sensor 70; a distributor 72; an aperture sensor 74 for the intake throttle valve 16; a knock sensor 76; a water temperature sensor 78; and a vehicle velocity sensor 80. Reference numerals 82 and 84 represent an ignition coil and a power unit for ignition, respectively.

Further, the internal combustion engine 2 has a first $O_2$ sensor 86 and a second $O_2$ sensor 88 disposed on an upstream side and a downstream side of the catalyzer 28, respectively in the exhaust path 6. The first and second $O_2$ sensors 86 and 88 are exhaust sensors which detect an exhaust component value, i.e., oxygen concentration. The first $O_2$ sensor 86 and the second $O_2$ sensor 88 are connected to the control station 68.

Reference numerals 90, 92, 94, 96, 98, 100, 102, 104, and 106 respectively represent: a dash pot; a thermostat fuse; an alarm relay; a warning lamp; a diagnosis switch; a TS switch; a diagnosis lamp; a main switch; and a battery.

The air-fuel ratio control system provides feedback control over operation of the fuel injection valve 30 by means of the control station 68 such as to permit an air-fuel ratio to achieve its target value in accordance with a first detection signal and a second detection signal from the first $O_2$ sensor 86 and the second $O_2$ sensor 88, respectively. The air-fuel ratio control system assists the catalyzer 28 in improving exhaust clean-up efficiency so as to lower the amounts of noxious components in the exhaust emissions.

Figure 13:
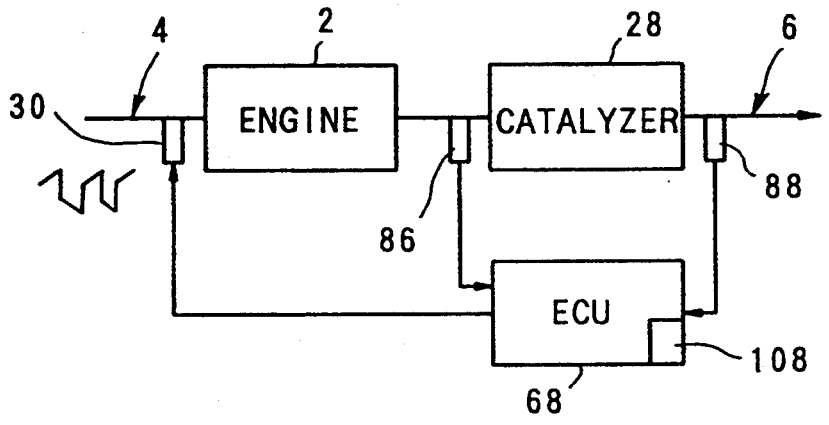
FIG. 13 is a block diagram illustrating an air-fuel ratio control system in which two $O_2$ sensors are disposed.
Figure 14:
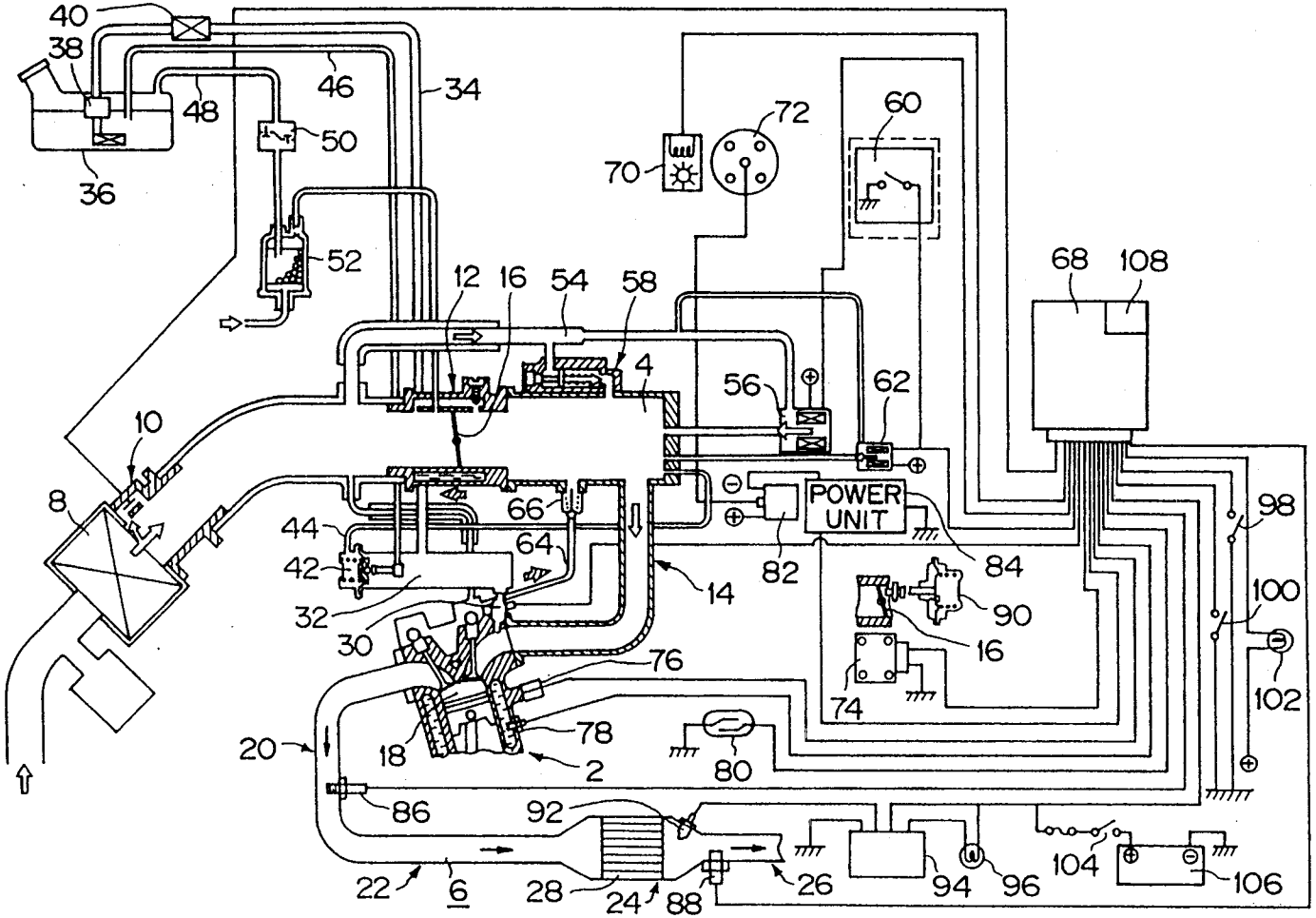
FIG. 14 is a schematic block diagram depicting the air-fuel ratio control system having first and second, sensors disposed therein.
Figure 15:
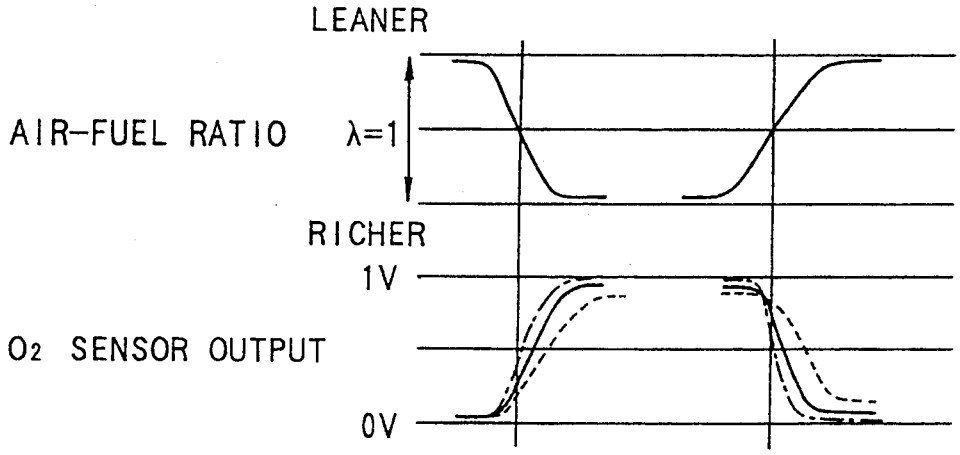
FIG. 15 is a graph showing a relationship between an air-fuel ratio, which is achieved by an exemplary conventional air-fuel ratio control system, and a detection signal which is sent out from an $O_2$ sensor located in the above conventional control system.
Figure 16:
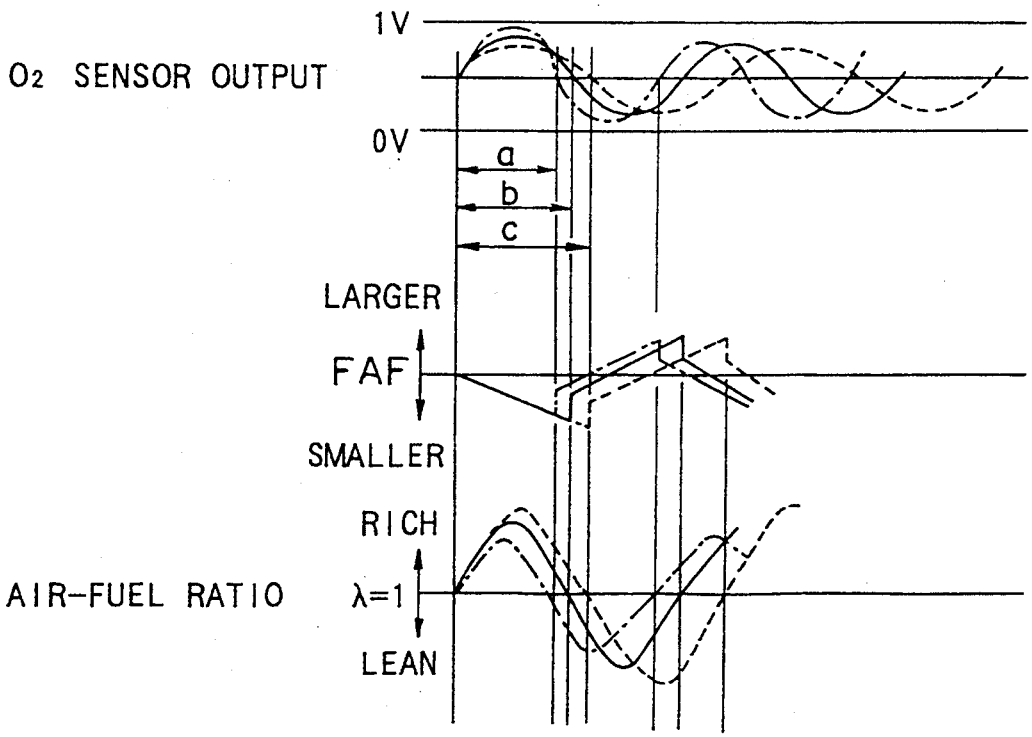
FIG. 16 is a graph showing a relationship between the detection signal, which is sent out from the $O_2$ sensor of the exemplary conventional air-fuel ratio control system, the ensuing feedback control quantity, and the resulting air-fuel ratio.

As more specifically illustrated in FIG. 13, the air-fuel ratio control system for use in the internal combustion engine 2 has two sensors, i.e., the first $O_2$ sensor 86 and the second $O_2$ sensor 88, disposed respectively upstream and downstream from the catalyzer 28 in the exhaust path 6. The control station 68 effects a first feedback control such as to match the air-fuel ratio with its target value in accordance with the first detection signal that is sent out from the first $O_2$ sensor 86. Further, the control station 68 governs the first feedback control in response to the second detection signal that is sent out from the second $O_2$ sensor 88, so as to allow the first feedback control to be corrected.

Figure 12:
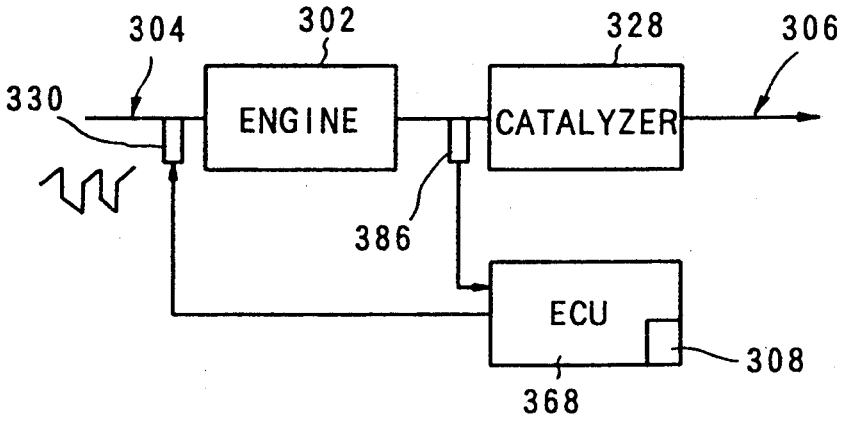
FIG. 12 is a block diagram illustrating an air-fuel ratio control system in which a single $O_2$ sensor is disposed.

In FIG. 12, there is shown another air-fuel ratio control system in which a single $O_2$ sensor 386 is located upstream from a catalyzer 328 in an exhaust path 306. A control station 368 effects feedback control in accordance with a detection signal emitted from the single $O_2$ sensor 386, in order to match an air-fuel ratio with its target value. The embodiment of FIGS. 13 and 14 illustrates how the first feedback control of an air-fuel ratio, through the first $O_2$ sensor 86, is corrected in the air-fuel ratio control system where the first $O_2$ sensor 86 is positioned upstream from the catalyzer 28 in the exhaust path 6. According to this embodiment, the control station 68 is provided with a correction section 108. When predetermined implementation conditions of correction determination are fulfilled, the correction section 108 detects a first response time which occurs after a change in an operating state of the internal combustion engine 2 occurs until the first detection signal from the first $O_2$ sensor 86 achieves a first determination signal value. In accordance with the detected first response time, the correction section 108 governs the first feedback control of an air-fuel ratio, which has been effected by means of the first $O_2$ sensor 86, in order to correct the first feedback control.

Further, in an air-fuel ratio control system for use in an internal combustion engine 302 as shown in FIG. 12, when predetermined implementation conditions of correction determination are satisfied, a correction section 308, which is provided in the control station 368, detects response time in which after a change in an operating state of the internal combustion engine 302 occurs until the detection signal from the $O_2$ sensor 386 achieves a determination signal value. In accordance with the detected response time, the correction section 308 assumes air-fuel ratio feedback control, which has been effected by means of the $O_2$ sensor 386, so as to correct the feedback control.

It will now be described with reference to FIGS. 1 through 11 how the air-fuel ratio control system of FIGS. 13–14 provides feedback control with only one sensor (86) as shown in the system of FIG. 12.

With reference to FIG. 1, an internal combustion engine 2 is started at step 200. Predetermined implementation conditions of correction determination are read at step 201, and it is determined at step 202 whether the predetermined implementation conditions have been fulfilled.

Figure 2:
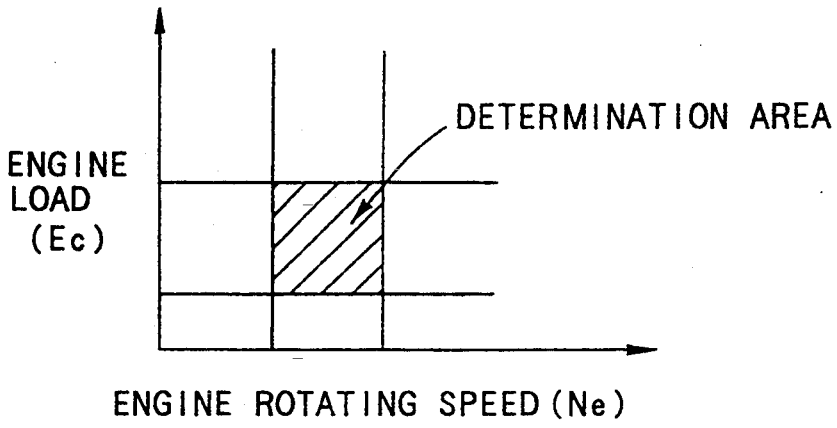
FIG. 2 is a descriptive illustration showing a determination area which constitutes one of the implementation conditions of correction determination.

FIG. 2 shows the implementation conditions of correction determination. It is determined whether these conditions satisfy all of the following: engine data falls within a determination area which is defined by both engine load "Ec" and engine rotating speed "Ne"; warming-up of the internal combustion engine 2 has been completed; the first $O_2$ sensor 86 has no failures; the first $O_2$ sensor 86 is not inactive; and, the internal combustion engine 2 is in an operating state of acceleration or deceleration. Further, conditions of the operating state of the internal combustion engine 2 may be divided into three sub-conditions: the engine 2 is accelerated or decelerated while air-fuel ratio feedback control is effected; the engine 2 is decelerated while increased acceleration quantity is corrected; and the engine 2 is accelerated after fuel is cut-off. Thus, the implementation conditions of correction determination may be determined from each of the above three sub-conditions.

Figure 3:
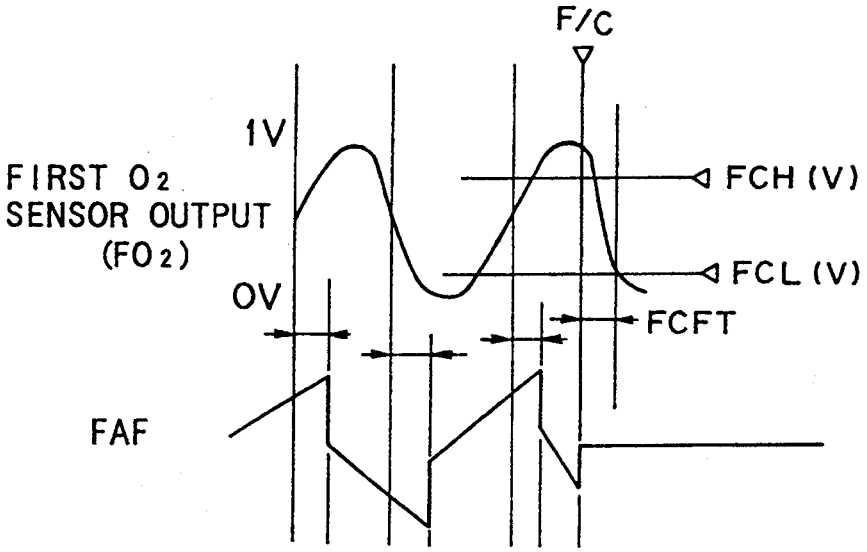
FIG. 3 is a graph showing a relationship between a first detection signal, which is sent out from a first $O_2$ sensor, and the resulting first feedback control quantity.

When the answer to the determination in step 202 is "NO" because any one of the implementation conditions of correction determination is unsatisfied, control is returned to step 201 at which time the implementation conditions of correction determination are read again. When the answer to the determination in step 202 is "YES" (because all of the implementation conditions are satisfied), the routine is advanced to step 203 where measurement of a first response time "FCFT" is made. As illustrated in FIG. 3, a first detection signal "$FO_2$", which is sent out from the first $O_2$ sensor 86, passes between a first low determination signal value "FCL" and a first high determination signal value "FCH".

The first response time "FCFT" of the first $O_2$ sensor 86 is the time necessary for the first detection signal "$FO_2$" sent out from the first $O_2$ sensor 86 to pass between the first low and high determination signal values "FCL" and "FCH". In general, the response time of the $O_2$ sensor increases in accordance with the deterioration of the $O_2$ sensor.

Requirements of measuring the first response time "FCFT" include:

(1) the time necessary for the first detection signal "$FO_2$" to reach the first high determination signal value "FCH" after an acceleration quantity increase is initiated, when the internal combustion engine is accelerated during air-fuel ratio feedback control, and when the first detection signal "$FO_2$" sent out from the first $O_2$ sensor 86 is lower than the first low determination signal value "FCL";

(2) the time necessary for the first detection signal "$FO_2$" to reach the first low determination signal value "FCL" after fuel is cut-off "F/C", when the internal combustion engine is decelerated during air-fuel ratio feedback control, and when the first detection signal "$FO_2$" is higher than the first high determination signal value "FCH";

(3) the time necessary for the first detection signal "$FO_2$" to reach the first low determination signal value "FCL" after fuel is cut-off, and when the internal combustion engine is decelerated while acceleration quantity increase is corrected; and (4) the time necessary for the first detection signal "$FO_2$" to reach the first high determination signal value "FCH" after acceleration quantity increase is initiated, and when the internal combustion engine is accelerated while air-fuel ratio feedback control is effected.

According to the present embodiment, the above-listed requirement No. (2) as illustrated in FIG. 3, will be described as the first response time "FCFT", i.e., the time necessary for the first detection signal "$FO_2$" to reach the first low determination signal value "FCL" after fuel is cut-off "F/C" when the internal combustion engine is decelerated during air-fuel ratio feedback control, and when the first detection signal "$FO_2$" from the first $O_2$ sensor 86 is higher than the first high determination signal value "FCH". As seen therein, "FAF" represents the corrected quantity of air-fuel ratio feedback control through the first $O_2$ sensor.

Figure 4:
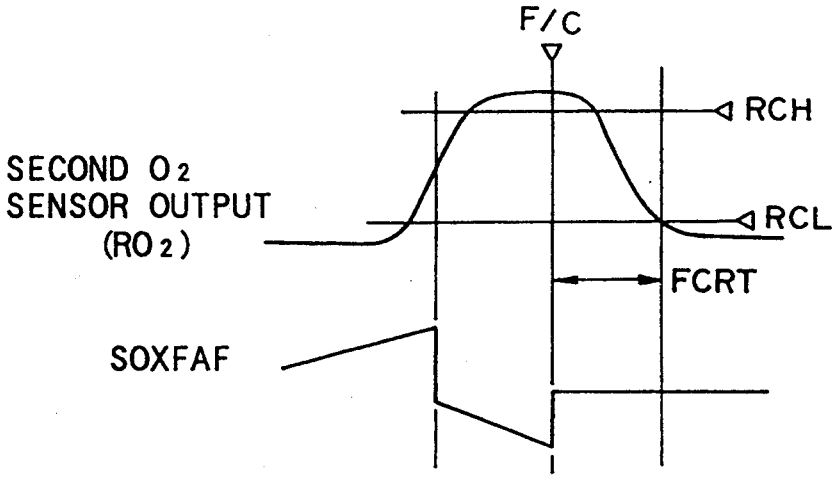
FIG. 4 is a graph showing a relationship between a second detection signal, which is sent out from a second $O_2$ sensor, and the resulting second feedback control quantity.

As illustrated in FIG. 4, if correction is to be made by means of a second $O_2$ sensor 88, a second response time "FCRT" represents the time required for a second detection signal "$RO_2$" which is sent out from the second $O_2$ sensor 88, to pass between second low and high determination signal values "RCL" and "RCH" after a change in an operating state of the internal combustion engine 2, i.e., fuel cut-off occurs. As seen therein, "SOXFAF" represents the corrected quantity of air-fuel ratio feedback control through the second $O_2$ sensor.

Figure 5:
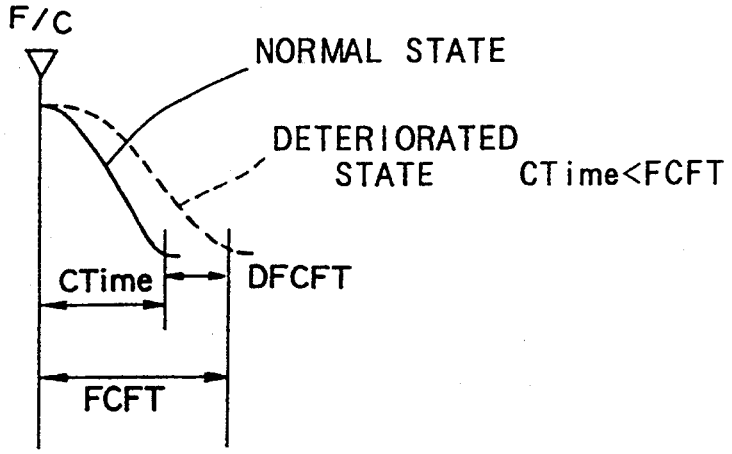
FIG. 5 is a graph showing a relationship between first response time from the time of fuel cut-off and response reference time.
Figure 6:
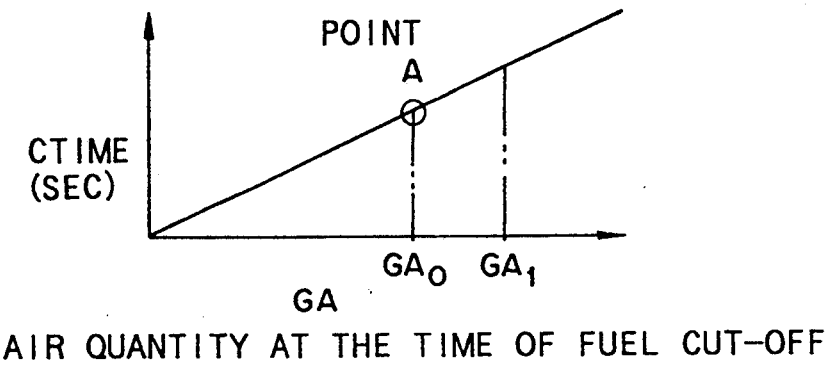
FIG. 6 is a graph showing a relationship between air quantity at the time of fuel cut-off and the response reference time.

Next, as shown in FIG. 5, determination is made at step 204 of a difference "DFCFT" between the measured first response time "FCFT" and a response reference time "CTIME" (i.e., CTIME−FCFT=DFCFT). The difference "DFCFT" is a deviation of the first response time "FCFT" with respect to the response reference time "CTIME". The response reference time "CTIME" represents the response time of the first $O_2$ sensor 86 when the first $O_2$ sensor 86 is in a normal state. As illustrated in FIG. 6, according to the present embodiment, the response reference time "CTIME" is set for each air quantity "GA" at the time of fuel cut-off.

A ratio of the determined deviation "DFCFT" to the response reference time "CTIME" that is, a variation ratio "FRAT" (DFCFT/CTIME=FRAT) is determined at step 205. Next, it is determined at step 206 whether the variation ratio "FRAT" has been measured a predetermined number of times, for example, twenty times.

When the answer to the determination in step 206 is "NO", control is returned to step 201 which reads the implementation conditions of correction determination again. When the answer to the determination in step 206 is "YES", one set of values in the range of a maximum value "$FRAT_{max}$" to a value in the order of "n(i)" from "$FRAT_{max}$" as well as the other set of values in the range of a minimum value "$FRAT_{min}$" to a value in the order of "n(i)" from "$FRAT_{min}$" are deleted from a set of variation ratios "FRAT" which have been derived from measurements of "FRAT" for the predetermined number of times. Thereafter, an average "$FRATAV_{new}$" of the remaining variation ratios "FRAT" is calculated.

Figure 7:
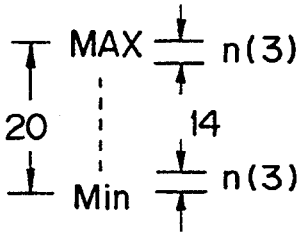
FIG. 7 is a descriptive illustration showing how an average of variation ratios is calculated.
Figure 8:
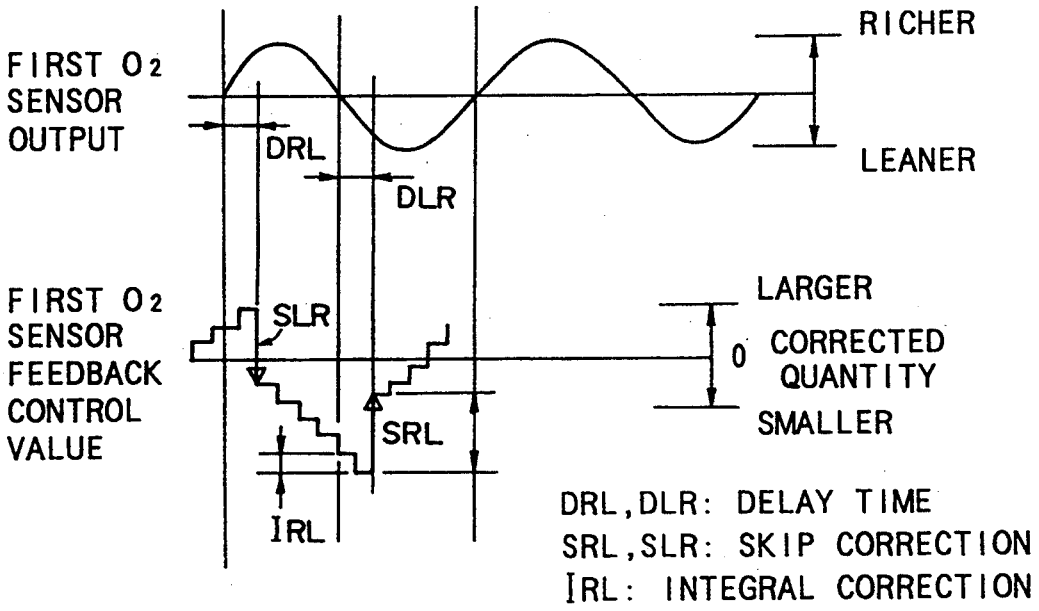
FIG. 8 is a graph illustrating a relationship between the first detection signal from the first $O_2$sensor and the resulting first feedback control value.
Figure 9:
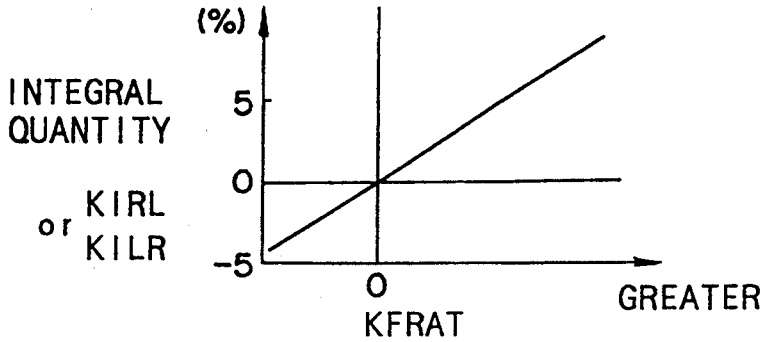
FIG. 9 is a graph showing a relationship between a correction constant and the ensuing corrected integral quantity.
Figure 10:
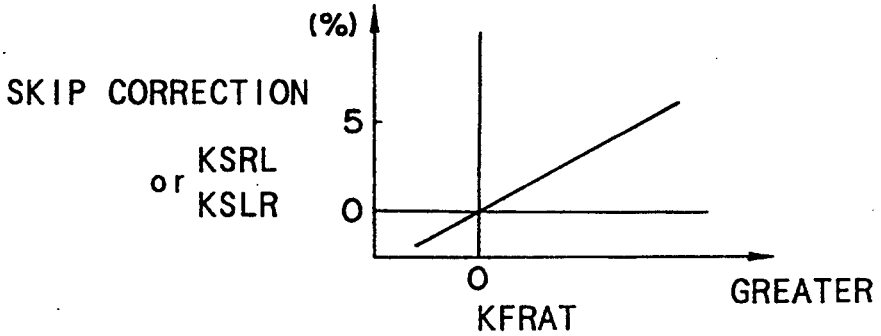
FIG. 10 is a graph showing a relationship between the correction constant and the ensuing corrected skip quantity.
Figure 11:
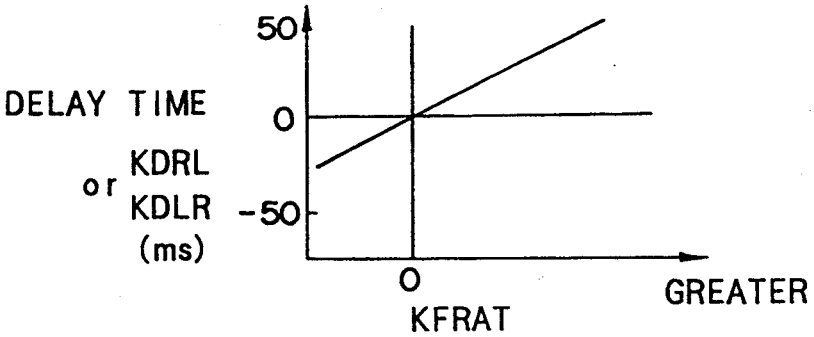
FIG. 11 is a graph showing a relationship between the correction constant and the ensuing corrected delay time.

As shown in FIG. 7, one set of values in the range of the maximum value "$FRAT_{max}$" and, for example, a third "n(3)", which lies from "$FRAT_{max}$" in the direction of the minimum value "$FRAT_{min}$", is deleted from the set of variation ratios "FRAT" which have been measured twenty times. Further, the other set of values in the range of the minimum value "$FRAT_{min}$" and a third "n(3)", which lies from the "$FRAT_{min}$" in the direction of the maximum value "$FRAT_{max}$", is deleted from the set of variation ratios "FRAT" at step 207. The average "$FRATAV_{new}$" of the remaining fourteen variations ratios "FRAT" is calculated at step 208.

The calculated average "$FRATAV_{new}$" is replaced by a correction constant "KFRAT" of the first $O_2$ sensor 86 in first feedback control. The correction constant "KFRAT" is calculated at step 209 from a previous average "$FRATAV_{old}$" and the present average "$FRATAV_{new}$". The correction constant "KFRAT" is a variation value of the first $O_2$ sensor 86 for correcting the first feedback control, and is calculated as an average of the previous "FRATAV" and the present "FRATAV" in order to eliminate any variation that may occur only once in the calculation.

The correction constant "KFRAT", which has been calculated in step 209, is checked to determine whether "KFRAT" ranges from at least a lower limit constant "LIML" to at most an upper limit constant "LIMH" at step 210. This determination is made to see if the correction constant "KFRAT" i.e. the variation value of the first $O_2$ sensor 86, falls within a correctable range of variations.

When it is found by the determination in step 210 that the correction constant "KFRAT" lies in the range of the lower limit constant "LIML" to the upper limit constant "LIMH" (i.e., when the answer to step 210 is "YES"), the first feedback control, which has been effected by means of the first $O_2$ sensor 86, is controlled in response to the correction constant "KFRAT" at step 211 so as to be corrected, as shown in FIGS. 8 through 11.

The corrected quantity at this time is obtained from an increase or a decrease in the correction constant "KFRAT" at step 212 on the basis of a corrected quantity, "I.S.D.", which is used in formal feedback control. As more specifically shown in FIGS. 9 through 11, the following is determined from the correction constant "KFRAT"; a richer corrected integral quantity, "KIRL"; a richer corrected skip quantity, "KSRL"; and a richer corrected delay time, "KDRL" (or alternatively, a leaner corrected integral quantity, "KILR"; a leaner corrected skip quantity, "KSLR"; and a leaner corrected delay time, "KDLR"). Next, the above determined amounts are added respectively to (or, subtracted respectively from): a previous richer integral quantity, "$IRL_{old}$"; a richer skip quantity, "$SRL_{old}$"; and a richer delay time, "$DRL_{old}$" (or alternatively, a previous leaner integral quantity, "$ILR_{old}$"; a leaner skip quantity, "$SLR_{old}$"; and a leaner delay time, "$DLR_{old}$"). As a result, the following is obtained from the above respectively: a richer integral quantity, "IRL"; a richer skip quantity, "SRL"; and a richer delay time, "DRL" (or, a leaner integral quantity, "ILR"; a leaner skip quantity, "SLR"; and a leaner delay time, "DLR").

The correction constant "KFRAT", which has been calculated in step 209 as previously described, is stored in a non-volatile memory (not shown) of the control station 68, and is used at step 213 to correct first feedback control when air-fuel ratio feedback control is effected. After correction is made, the control returned to step 201 at which time the implementation conditions of correction determination are read again.

When it is found from the previously noted determination in step 210 that the correction constant "KFRAT" is either less than the lower limit constant "LIML" or greater than the upper limit constant "LIMH" (that is, the answer to the determination in step 210 is "NO"), the correction constant "KFRAT" falls out of the correctable range of variations. This means that there are abnormalities in the first $O_2$ sensor 86. Thus, a warning means such as a warning lamp (not shown) is actuated to issue a warning at step 214. Air-fuel ratio feedback control through the first $O_2$ sensor 86 is ceased, and the corrected quantity is set to "0" or zero at step 215. Thereafter, the above described steps are repeated at step 216.

Accordingly, in the above-described air-fuel ratio control system, when predetermined implementation conditions of correction determination are satisfied, the correction section 108, which is incorporated in the control station 68, detects a first response time that elapses from the moment a change in an operating state of the internal combustion engine 2 occurs to the moment the first detection signal from the first $O_2$ sensor 86 achieves a first determination signal value. In accordance with the detected first response time, the control section 108 assumes a first feedback control over an air-fuel ratio, which has been exercised by means of the first $O_2$ sensor 86, so as to permit the first feedback control to be corrected. In this way, the use of the single first $O_2$ sensor 86 can correct variations in the detection signal from the first $O_2$ sensor 86, which result from manufacturing non-uniformities, deterioration during use, or the like of the first $O_2$ sensor 86. As a result, air-fuel ratio feedback control is achievable.

The above arrangement eliminates the need for two sensors, i.e., the first $O_2$ sensor 86 and the second $O_2$ sensor 88, to be provided in such an air-fuel ratio control system as shown in FIGS. 13 and 14. That is, the control system shown therein provides feedback control so as to match an air-fuel ratio with its target value in accordance with the first and second detection signals which are sent out respectively from the first and second $O_2$ sensors 86 and 88. In contrast, as illustrated in FIG. 12, the use of the single $O_2$ sensor 386 enables air-fuel ratio feedback control, while correcting variations in the detection signal from the $O_2$ sensor 386. This system can achieve a reduction in costs, and allows high-precision feedback control such that an air-fuel ratio achieves its target value.

Furthermore, according to the air-fuel ratio control system illustrated in FIGS. 13 and 14 in which air-fuel ratio feedback control is effected by means of the two, first and second, $O_2$ sensors 86 and 88, a second feedback control, which is effected in dependence upon the second $O_2$ sensor 88 located downstream from the catalyzer 28 in the exhaust path 6, is corrected by the correction section 108 in accordance with a second response time of a second detection signal which is sent out from the second $O_2$ sensor 88. This arrangement can correct variations in the second detection signal, which result from manufacturing non-uniformities, deterioration during use, or the like of the second $O_2$ sensor 88. As a consequence, air-fuel ratio feedback control with a further degree of accuracy is achievable.

As can be seen from the above, according to the present invention, the use of a single exhaust sensor can correct its detection signal variations which result from the manufacturing non-uniformities, deterioration during use, and the like of the exhaust sensor. As a result, air-fuel ratio feedback control can be executed.

The above arrangement eliminates the need for two, first and second, exhaust sensors to be provided in an air-fuel ratio control system in which feedback control is effected so as to match an air-fuel ratio with its target value in accordance with first and second detection signals which are sent out respectively from the first and second exhaust sensors. Accordingly, the use of the single exhaust sensor enables air-fuel ratio feedback control, while correcting variations of the detection signal from the exhaust sensor. This system can achieve a reduction in costs, while allowing high-precision feedback control such that the air-fuel ratio achieves its target value.

Furthermore, in the air-fuel ratio control system which effects air-fuel ratio feedback control by means of the two, first and second, exhaust sensors, second feedback control, which is effected in dependence upon the second exhaust sensor located downstream from the catalyzer in the exhaust path, is corrected in accordance with a second response time of the second detection signal which is sent out from the second exhaust sensor. This arrangement can correct variations in the second detection signal, which result from the manufacturing non-uniformities, deterioration during use, and the like of the second exhaust sensor. As a result, air-fuel ratio feedback control with a further degree of accuracy is achievable.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an air-fuel ratio control system for an internal combustion engine including an exhaust sensor located in an exhaust path of said internal combustion engine and control means for effecting a feedback control to match an air-fuel ratio with a target value in accordance with a detection signal from said exhaust sensor, the improvement wherein said control means includes a correction section for correcting variations in the detection signal from the exhaust sensor to enable the air-fuel ratio to achieve the target value, said correction section comprising:

means for determining whether predetermined implementation conditions of correction determination are satisfied;

means for detecting a response time that elapses from an occurrence of a change in an operating state of the engine until the detection signal from the exhaust sensor achieves a determination signal value; and means for governing the feedback control over the air-fuel ratio in accordance with said detected response time to correct the feedback control, said governing means including:

means for determining a difference time between said detected response time and a response reference time which represents a response time of said exhaust sensor in a normal state;

means for determining a ratio value of said difference time to said response reference time;

means for calculating a correction constant based upon a predetermined number of accumulated ratio values; and means for determining whether said correction constant falls within a correctable range of variations.

2. The control system as claimed in claim 1, wherein said governing means further includes means for issuing a warning if it is determined that said correction constant falls outside said correctable range of variations.

* * * * *